United States Patent [19]

Soltis

[11] 4,133,653

[45] Jan. 9, 1979

[54] AIR FILTRATION ASSEMBLY

[75] Inventor: Charles W. Soltis, Houston, Tex.

[73] Assignee: Filterlab Corporation a subsidiary of Masco Corporation, Houston, Tex.

[21] Appl. No.: 820,639

[22] Filed: Aug. 1, 1977

[51] Int. Cl.[2] ..... B03C 3/32

[52] U.S. Cl. ..... 55/126; 55/131; 55/138; 55/141; 55/145; 55/146; 55/147; 55/155

[58] Field of Search ..... 55/124, 126, 131, 138, 55/139, 141, 146, 147, 155, 145

[56] References Cited

U.S. PATENT DOCUMENTS

| | | | |
|---|---|---|---|
| 1,994,259 | 3/1935 | Thorne | 55/146 |
| 2,925,881 | 2/1960 | Berly et al. | 55/146 |
| 2,933,151 | 4/1960 | Kurtz | 55/124 |
| 3,040,497 | 6/1962 | Schwab | 55/131 |
| 3,073,094 | 1/1963 | Landgraf et al. | 55/126 |
| 3,581,462 | 6/1971 | Stump | 55/131 |
| 3,704,572 | 12/1972 | Gourdine et al. | 55/126 |
| 3,735,560 | 5/1973 | Wellman | 55/129 |
| 3,763,633 | 10/1973 | Soltis | 55/126 |
| 4,007,024 | 2/1977 | Sallee et al. | 55/126 |
| 4,022,594 | 5/1977 | Baysek | 55/146 |

*Primary Examiner*—Bernard Nozick
*Assistant Examiner*—David L. Lacey
*Attorney, Agent, or Firm*—Kane, Dalsimer, Kane, Sullivan and Kurucz

[57] ABSTRACT

The disclosure is of an air filtering assembly which may be usefully installed as a filter component in conventional residential and commercial air-conditioning systems. The assembly is effective in filtering out allergens and even particles as small as 0.3 microns in size (which are the average size for tobacco smoke particles). The assembly comprises a housing, prefilter, collector section, ionizing section and a unique mode of suspending the ionizing wire in the ionizing section. The wire is supported on a spring-loaded insulator which "floats" on the end of the ground blade component. The advantage of the latter feature is its facilitation of the threading of the ionizing wire during production, thereby reducing the cost of manufacture.

14 Claims, 7 Drawing Figures

AIR FILTRATION ASSEMBLY

BACKGROUND OF THE INVENTION

1. Field of the Invention

The invention relates to electrostatic air filtration assemblies for use in air-conditioning units.

2. Brief Description of the Prior Art

The art is replete with descriptions of electrostatic air filtration units; see for example the disclosures of U.S. Pat. Nos. 3,626,669; 3,665,679; 3,727,380; 3,733,783; 3,735,560; 3,763,633; and 3,800,509. In spite of the seemingly well developed state of the art, there has remained a need for a relatively inexpensive electrostatic air filtration unit having a high efficiency for removing minute particles, particularly smoke particles, from the air. The assembly of my invention meets this particular need.

SUMMARY OF THE INVENTION

The invention comprises an air filtration assembly, which comprises;

(a) a support frame defining the periphery of an air-flow chamber which is open at first and second ends;

(b) an air-permeable collector unit mounted within said chamber, closing the first end, said unit comprising, (i) a first web of a dielectric filter;

(ii) a second web of a dielectric filter;

(iii) electrode means comprising an electrical conducting grid sandwiched between the first and second webs;

(iiii) means connected to said grid for applying a positive electrical charge thereto; and (iiiii) means for electrically insulating said unit from the support frame;

(c) an air-permeable ionizer unit mounted within said chamber, closing the second end, said ionizer unit comprising, (i) a plurality of substantially flat blades, positioned generally parallel to each other and spaced apart to form interposed air-flow passages between the second end and the collector unit;

(ii) a plurality of insulator members, one resiliently mounted on each end of said blades so as to be resiliently movable along a plane coextensive with the axis of said blades along their length, said members having a surface portion raised above a flat surface of said blades;

(iii) an electrical conducting wire mounted on and stretched between the insulator members on each blade end, said wire being spaced above a flat surface of the blade; and (iiii) means connected to said wire and said blades for applying a positive electrical charge to the wire and a negative charge to the blades.

The assembly of the invention will remove up to 85 percent of particles entrained in an air flow and having sizes ranging from 0.01 to 1.0 microns. This is particularly useful for filtering tobacco smoke particles out of the air. Up to 90 percent of larger particles are removed with the filter assembly of the invention.

BRIEF DESCRIPTION OF THE DRAWINGS

FIG. 1 is a view in part of an air-conditioning machine including as a component an air-filtration embodiment assembly of the invention.

DETAILED DESCRIPTION OF THE PREFERRED EMBODIMENTS OF THE INVENTION

Those skilled in the art will readily appreciate the invention from a reading of the following description of the preferred embodiments in conjunction with the accompanying drawings of FIGS. 1–7, inclusive.

FIG. 1 is a view in part of an air-conditioning machine including as a component an air-filtration assembly 10 of the invention mounted in the return air duct of a forced air type of appliance. The assembly 10 is an electrostatic air filter powered by a power source 31 through coaxial cable 33. Electrostatic air filtration devices filter foreign particles from the air by applying an electrostatic charge to the particles passing in an air flow through the filter assembly. An opposite charge is placed in a collector zone of the filter assembly so that the charged particles are attracted and accumulated as a deposit at the oppositely charged site.

Figure 2:
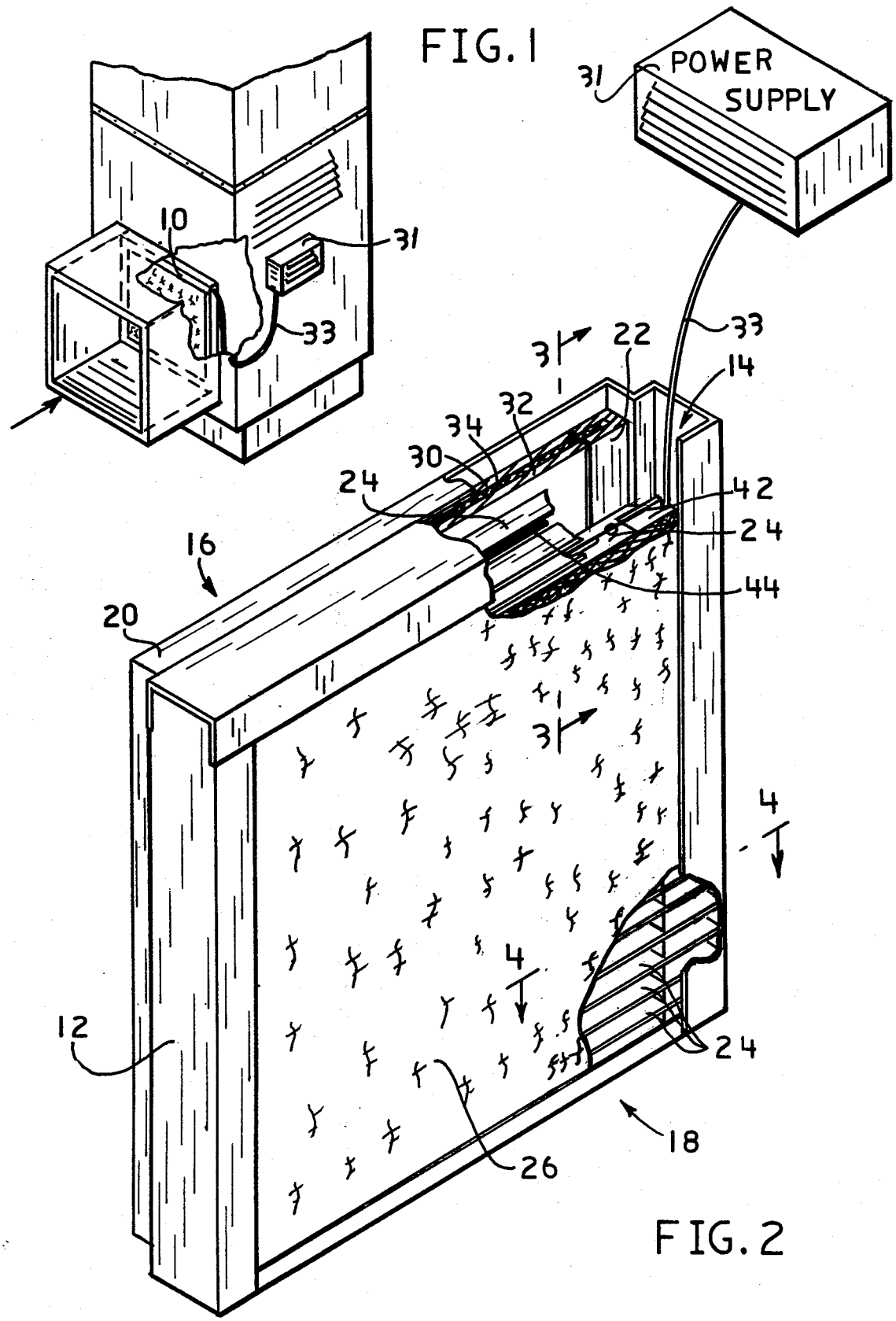
FIG. 2 is an isometric view, partly cut away, of the assembly of FIG. 1.

FIG. 2 is an isometric view of the assembly 10 of the invention as viewed from the air inflow side and partially cut away to show interior components. The assembly 10 comprises a frame 12 for supporting assembly components. The frame 12 defines the periphery of a chamber 14 having an open first end 16 (not seen in FIG. 2) and an open second end 18 which is the air inflow end of the assembly 10. The frame 12 is preferably made of aluminum for its lightness and strength but it will be understood that other structural materials may also be employed. The frame 12 is designed with an offset 20 around the periphery to allow the assembly 10 to slide into a one-inch filter rack. This feature allows the assembly 10 to directly replace a standard one-inch glass fiber filter even though the total thickness of the filter assembly 10 may be several inches thick. The open end 16 of chamber 14 is closed with an air-permeable collector unit 22 which is mounted in chamber 14 and secured to frame 12. The open end 18 is closed by an air-permeable ionizing unit 24 which is also mounted in chamber 14 and secured to frame 12. In a particularly preferred embodiment assembly, a pre-filter 26 is interposed between ionizing unit 24 and the open end 18. Pre-filter 26 is a physical air filter designed to trap large dust and lint particles, for example, airborne fibers several hundred microns long. The prefilter 26 is integral to the electrostatic filter assembly 10 and forms a protective screen for the entering air side of the assembly. The prefilter 26 shown is a commercially available expanded aluminum filter material, but it should be understood that the prefilter is not limited to this material or design. As a further illustration, the prefilter 26 may be fabricated from fiberglass, woven and non-woven textile and open cell polymeric resin foam filter materials. The assembly 10 will function without a prefilter, but from a practical standpoint, the filter assembly 10 will load up much faster if a prefilter 26 is not used, hence the preference for inclusion of the prefilter 26 to reduce maintenance on the filter assembly.

Power to actuate the assembly 10 is provided from external power source 31 connected to assembly 10 by a coaxial cable 33. Power source 31 includes a transformer to convert household current such as 120 volt A.C. current to any desired D.C. voltage, for example circa 7000 volts. The filter assembly 10 described herein is advantageously operated at 7000 volts D.C., at about 3 milliamps but it should be understood that the voltage could be increased for higher efficiency or even decreased to as low as 5000 volts with slight decrease in efficiency and performance. The high voltage power supply 31 is shown as separate from the air filter assembly 10 but it could be located within the frame 12 if desired. The power supply 31 provides a means of applying a voltage charge to the collector unit 22 and the ionizing unit 24 through high voltage cable 33 which is connected to units 22, 24 in any conventional manner, for example through mounting posts, bus bars, printed circuit boards such as is described in U.S. Pat. No. 3,727,380 and the like. The negative line may be grounded to the air-conditioning unit of which assembly 10 forms a component, for safety. The collector unit 22 and the ionizing unit 24 are preferably insulated electrically from the frame 12 as will be described hereinafter.

Figure 3:
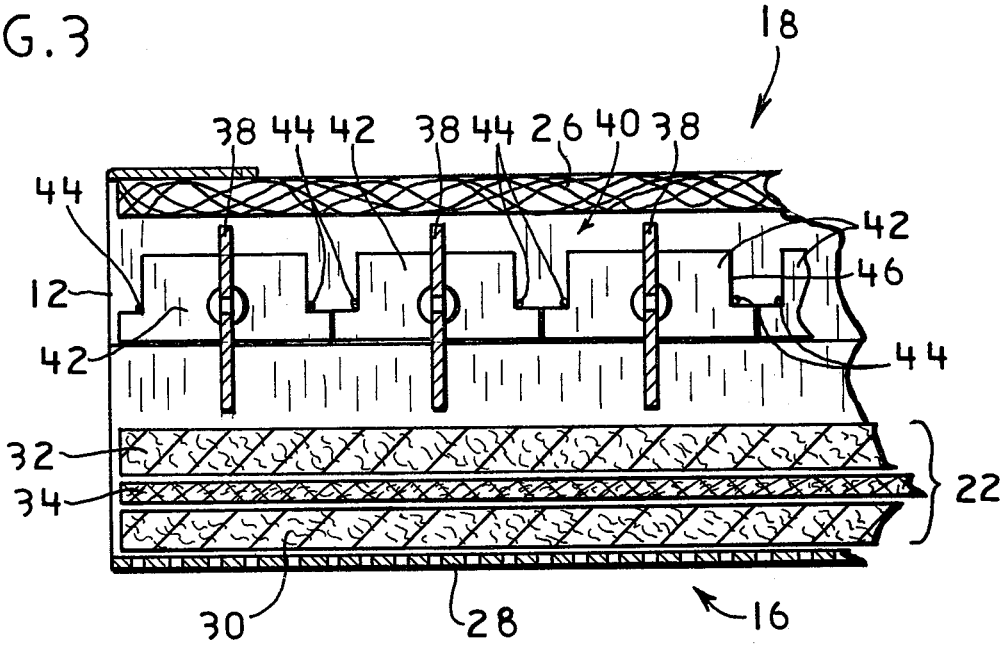
FIG. 3 is a view along lines 3—3 of FIG. 2.
Figure 4:
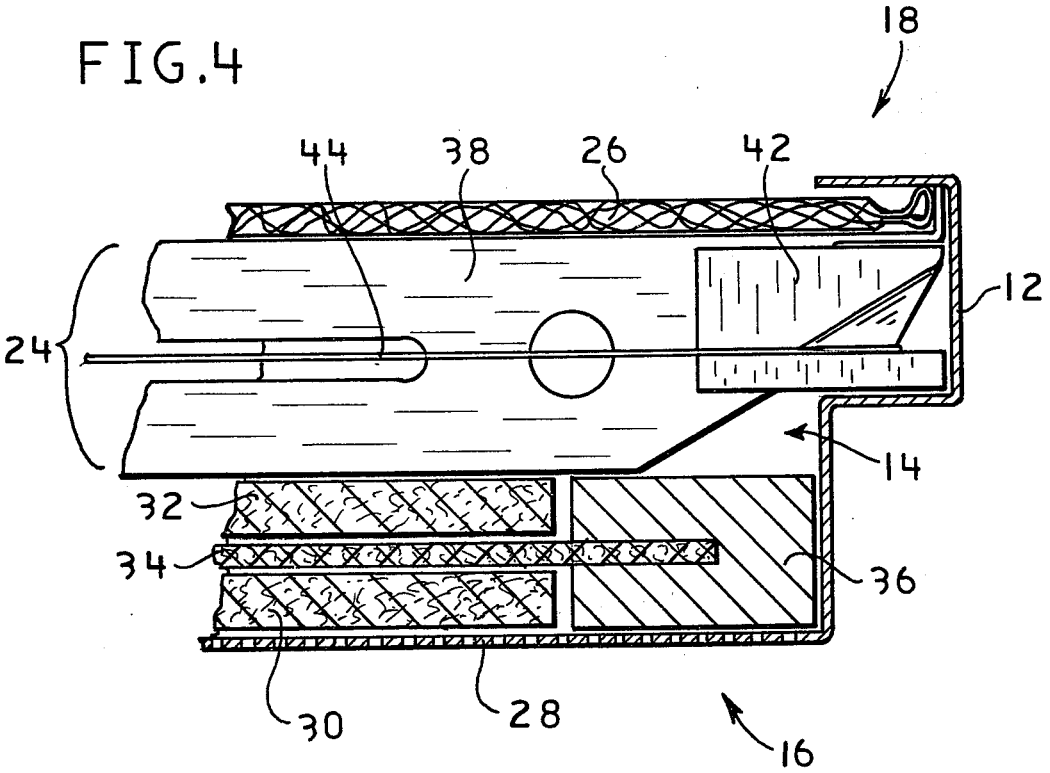
FIG. 4 is a view along lines 4—4 of FIG. 2.

FIG. 3 is a view along lines 3—3 of FIG. 2 and shows a peripheral edge of the assembly 10 in more detail. The open end 16 may be partly enclosed with a protective grill 28 to protect the collector unit 22. The collector unit 22 comprises a first web 30 and a second web 32 of a dielectric filter material. Webs 30, 32 may be sheets of dielectric filter media such as webs of woven and nonwoven polyester textile yarns or fibers, bats of polyester fiber blankets, glass fiber blankets and the like. Preferably webs 30, 32 are sheets of open cell, polyurethane foam such as is described in U.S. Pat. No. 3,171,820. Polyurethane foam filters are highly efficient and need only be on the order of about ¼ inch thick. Those skilled in the art will appreciate that the degree of efficiency of any given assemblies will be dependent in part on the degree of porosity selected for the webs 30, 32 employed. Polyurethane foams of a wide degree of porosity are available. In the preferred assembly of the invention, the polyurethane webs 30, 32 will have pore cell sizes on the order of about 0.05 to 20.0 mm, the pores being open and interconnected in a tortuous path. Between webs 30, 32 there is sandwiched a high voltage grid 34 which is preferably a perforated, conductive sheet permitting air flow therethrough. In our experience, a perforated sheet of aluminum providing about 60 percent open space is advantageous. The grid 34 is an electrode means positively charged with about 7000 volts D.C. in the assembly 10 during operation. Referring now to FIG. 4, a view along lines 4—4 of FIG. 2 one may see that the collector unit 22 also includes a ceramic insulator block 36 upon which grid 34 is insulatively mounted to serve as a means of insulating the charged portion of collector unit 22 from frame 12. The dielectric webs 30, 32 also "insulate" the charged grid 34 for safety, but are themselves charged by the high energy grid 34.

FIG. 4 also shows details of the mounting within chamber 14 of the ionizing unit 24. Ionizing unit 24 is an air-permeable component closing end 18 (the air-inflow end) of assembly 10 and comprises a plurality of blades 38 traversing the chamber 14. The blades 38 are positioned generally parallel to each other (see FIG. 3) to form interposed air-flow passage 40 between end 18 and the collector unit 22. The blades 38 may be fabricated from any electrically conductive material and are essentially long, substantially flat blades as shown in FIGS. 3 and 4. They are negatively charged, as will be described more fully hereinafter, during operation of the assembly 10 and may be secured directly to frame 12 if desired. Mounted on the ends of the blade 38 are insulator members 42 for supporting ionizing wire 44 in a spaced relationship between adjacent blades 38 and traversing the air flow passages 40. The insulators 42 have a surface portion 46 raised above the surface of blades 38 (see FIG. 3) to maintain the supported wire 44 spaced from blade 38. The ionizing wire 44 is stretched under tension between the ends of the blades 38 and preferably is a fine electrically conducting wire for example wire 44 may be 8 ml in diameter and may be formed of Tungsten. The wire 44, suspended between blades 38 is positively charged during operation of assembly 10 at circa 7000 volts D.C. and the blades 38 are oppositely charged and are at ground potential for safety by means of power supply 30 previously described.

Figure 5:
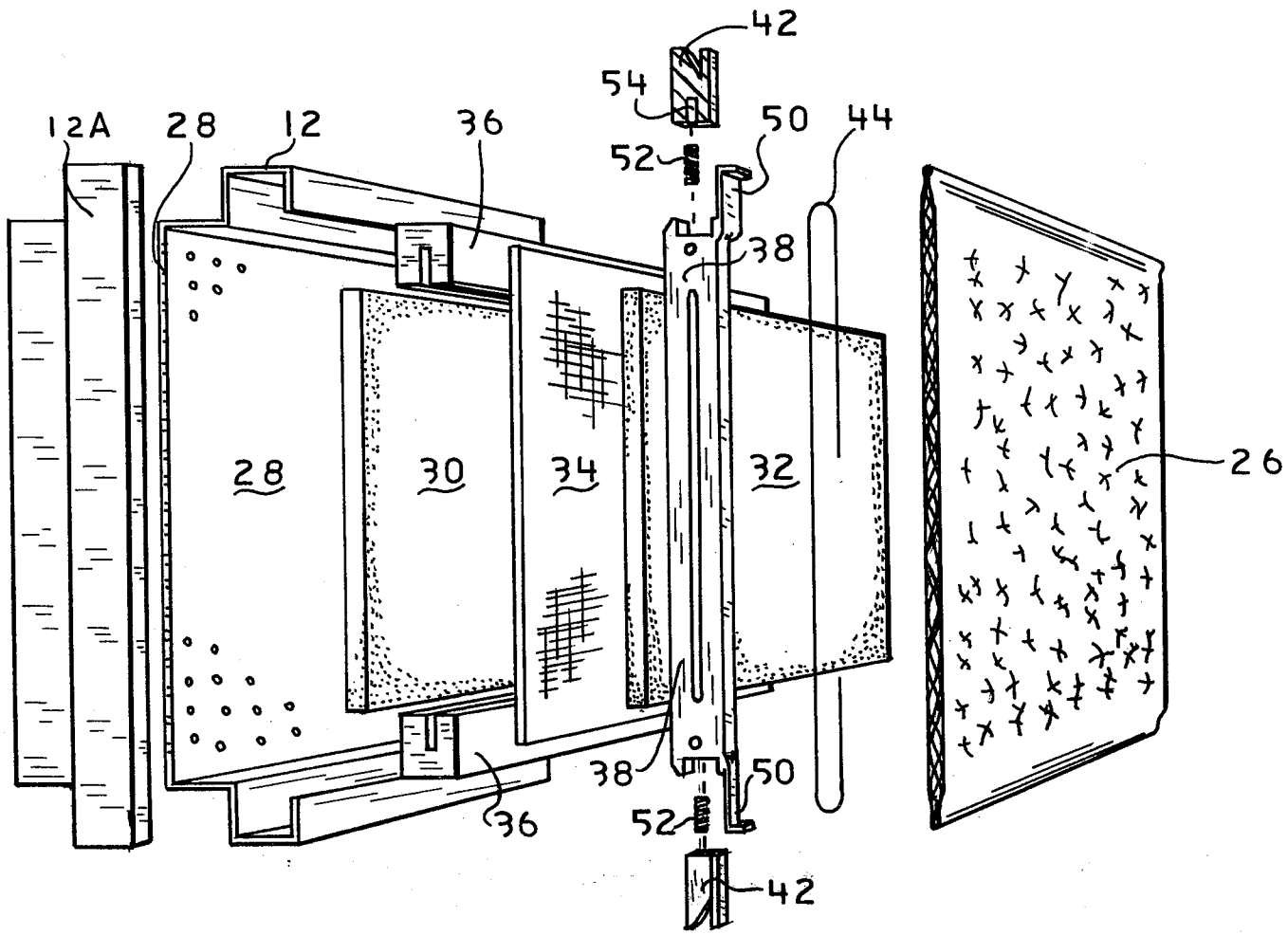
FIG. 5 is an exploded view from above of the assembly of FIG. 2 as shown in disassembly.

FIG. 5 is an exploded view from above of the assembly 10 of FIG. 2, shown in disassembly and shows the spatial relationships of the component parts. An end 12A of frame 12 may be removable to gain access to the chamber 14, thereby facilitating repair, maintenance and removal of component parts such as, for example removal of webs 30, 32 for periodic washing. The collector unit 22 can be mounted on tracks if desired to facilitate removal of the unit 22 as a whole for periodic cleaning or replacement of webs 30, 32.

Figure 6:
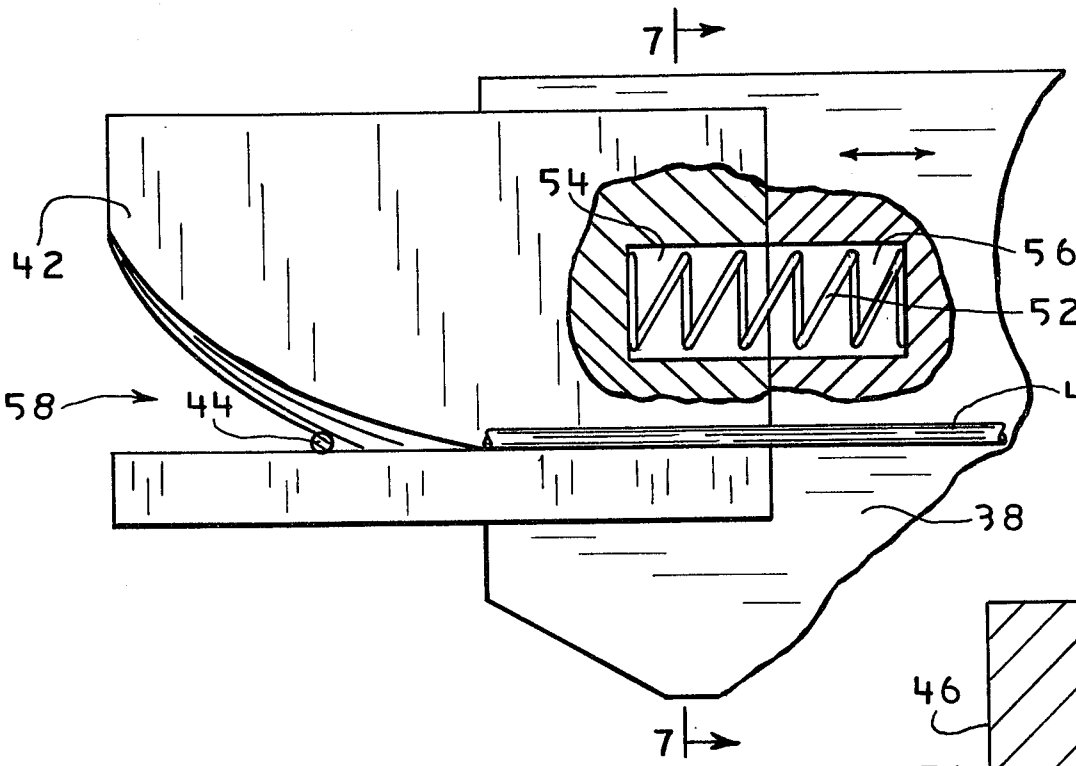
FIG. 6 is an enlarged view of an end of the ground blade component of the ionizing unit in the assembly of FIG. 2.
Figure 7:
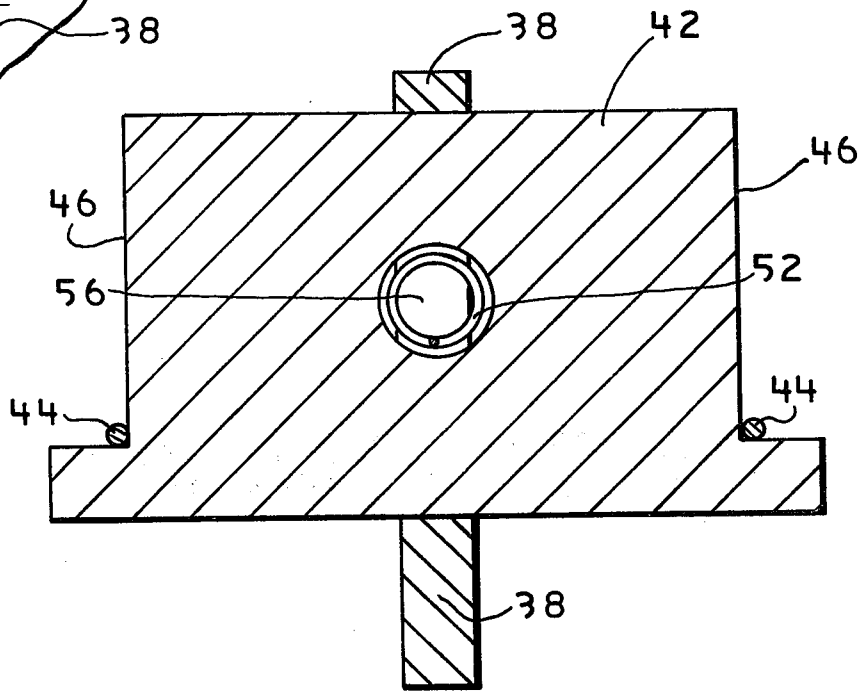
FIG. 7 is a view along lines 7—7 of the FIG. 6.

In FIG. 5, only one of the plurality of blades 38 are shown for the sake of simplicity. The blade 38 has a support member 50 for securing the negatively charged blade 38 to frame 12. The insulator members 42 are resiliently mounted on each end of blade 38, springs 52 providing the resilience. The springs 52 are mounted in a blind bore 54 (see cross-sectioned member 42 on the right side of FIG. 5) and exert a spring force between insulator member 42 and blade 38 when the member 42 is mounted on blade 38. The spring 52 is tensioned by wire 44 stretched tightly between right and left ends of blade 38 when wire 44 is mounted on the insulator members 42 as previously described. FIG. 6 is an enlarged view of an end of blade 38, partly cross-sectioned to show details of the resilient mounting of insulator member 42. The spring 52 is adapted to be received in slot 56 cut in the end of blade 38. The view of FIG. 6 also shows how wire 44 is held in groove 58 cut in the end of insulator 42 to secure it. In this manner, insulator 42 is movable, resiliently, along a plane coextensive with the lengthwise axis of blade 38 as shown by the arrows in FIG. 6. In effect, insulator 42 is a spring loaded insulator which floats on the end of each ground blade 38 as indicated in the FIG. 6. This spring loaded insulator will facilitate the threading of the ionizing wire 44 in a continuous serpentine manner to form the ionizing section. Most commercially available air cleaners utilize individually spring loaded ionizing wires which are complicated to fabricate and difficult to install. These difficulties are overcome by the structure of the invention shown in FIG. 6 and permits one to manufacture the ionizing unit 24 at an economic advantage, permitting the installation of a continuous length of ionizing wire 44. The installed, single continuous length is easily tensioned on the resilient insulators 42. This also results in fewer maintenance problems and a more efficient operation. There is also less potential hazard in that the ionizing wire 44 is constantly tensioned even if it should expand in length due to thermal conditions, obviating the chance that it could "droop" and come in contact with a blade 38. Further details of the insulator 42 and wire 44 may be seen in FIG. 7, a view along lines 7—7 of FIG. 6.

In operation, the imposed D.C. voltage causes an intensive, non-uniform, electrostatic field to form around the fine wire 44 which causes an ion flow between the wire and the flat blade 38. This ion flow bombards particles entrained in air and passing between the blades 38, i.e.; in air passages 40 and imparts a charge on the particles. The ionizer unit 24 and collector unit 22 constitute the high efficiency part of the filter assembly 10. Ionization imparts an additional charge on the particles improving their chance of being caught in the collector unit 22. As the charged particles or "ionized" particles enter the collector unit 22, still entrained in the air flow through assembly 10, they encounter the charged webs 30 and 32 and are attracted to and precipitated on webs 30, 32. The air-flow continues, minus the previously entrained, undesired particle contaminants.

Although the invention has been described in terms of certain preferred embodiments it should be understood that the invention is in no sense limited thereby and its scope is to be determined only by the appended claims.

I claim:

1. An air filtration assembly, which comprises;

(a) a support frame defining the periphery of an air-flow chamber which is open at first and second ends;

(b) an air-permeable collector unit mounted within said chamber, closing the first end, said unit comprising, (i) a first web of a dielectric filter;

(ii) a second web of a dielectric filter;

(iii) electrode means comprising an electrical conducting grid sandwiched between the first and second webs;

(iv) means connected to said grid for applying a positive electrical charge thereto; and (v) means for electrically insulating said unit from the support frame;

(c) an air-permeable ionizer unit mounted within said chamber, closing the second end, said ionizer unit comprising, (i) a plurality of substantially flat blades having flat surfaces and opposed ends and positioned generally parallel to each other and spaced apart to form interposed air-flow passages between the second end and the collector unit;

(ii) a plurality of insulator members with an individual insulator member on each end of each of said blades, resilient mounting means resiliently mounting each insulator member on each end of said blades so as to be resiliently movable along their length, said insulator members having a surface portion raised above said flat surface of said blades;

(iii) a continuous length of electrical conducting wire mounted on each insulator member and stretched and threaded in a serpentine pattern on and between the insulator members on each blade end, said wire being spaced above said flat surface of the blade, said resilient mounting means being operable to maintain a taut condition of the wire between each insulator member; and (iv) means connected to said wire and said blades for applying a positive electrical charge to the wire and a negative charge to the blades.

2. The assembly of claim 1 wherein said frame is made of aluminum material.

3. The assembly of claim 1 wherein the first web is fabricated from a polymeric resin foam.

4. The assembly of claim 3 wherein the foam is an open cell polyurethane.

5. The assembly of claim 1 wherein the first and second webs are fabricated from a polymeric resin foam.

6. The assembly of claim 5 wherein said foam is an open cell polyurethane.

7. The assembly of claim 6 wherein said grid is a perforated aluminum grid.

8. The assembly of claim 1 wherein said means for applying a charge is a transformer providing circa 7000 volts D.C.

9. The assembly of claim 1 wherein said means of insulating the collector unit from the frame comprises ceramic blocks mounted on the grid.

10. The assembly of claim 1 in which there is a prefilter covering the outside of the filtration assembly at the second end adjacent the ionization unit, to trap large dust and lint particles.

11. The assembly of claim 10 wherein said prefilter is fabricated from an expanded metal.

12. The assembly of claim 1 wherein the frame has an offset around the periphery to provide a projection around such periphery adapted to fit into the one-inch filter channel of a conventional air conditioning unit, whereby this assembly can replace a standard one-inch filter in such unit even though the assembly may have a total thickness larger than such standard one-inch filter.

13. The assembly of claim 1 wherein said flat blades are made of electrically conductive material.

14. The assembly of claim 1 wherein said resilient mounting means includes spring means between said insulator members and the flat blades.

* * * * *